US012533724B2

(12) United States Patent
Chen

(10) Patent No.: US 12,533,724 B2
(45) Date of Patent: Jan. 27, 2026

(54) FITTING CRIMPING TOOL WITH CHECK GAUGE MOUNT

(71) Applicant: JS Products, Inc., Las Vegas, NV (US)

(72) Inventor: Chungeng Chen, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 0 days.

(21) Appl. No.: 18/829,689

(22) Filed: Sep. 10, 2024

(65) Prior Publication Data

US 2025/0083212 A1 Mar. 13, 2025

Related U.S. Application Data

(60) Provisional application No. 63/537,678, filed on Sep. 11, 2023.

(51) Int. Cl.
*B21D 39/04* (2006.01)

(52) U.S. Cl.
CPC ..... *B21D 39/048* (2013.01)

(58) Field of Classification Search
CPC ..... B21D 39/048
See application file for complete search history.

(56) References Cited

U.S. PATENT DOCUMENTS

| | | | | |
|---|---|---|---|---|
| 1,320,103 | A | 10/1919 | Swickard | |
| 1,658,075 | A | 2/1928 | Butt | |
| 2,838,970 | A | 6/1958 | Motches et al. | |
| 2,900,854 | A | 8/1959 | Werner | |
| 3,084,575 | A | 4/1963 | Klein | |
| 3,330,148 | A | 7/1967 | Hornung | |
| 3,345,856 | A | 10/1967 | Werner et al. | |
| 3,487,524 | A | 1/1970 | Filia | |
| 4,926,685 | A | 5/1990 | Shannon, Sr. | |
| 5,195,353 | A | 3/1993 | Erbrick et al. | |
| 5,611,229 | A | 3/1997 | Chadbourne et al. | |
| 5,630,345 | A | 5/1997 | Ciccotelli | |
| 6,035,775 | A * | 3/2000 | Nghiem | B25B 27/10 72/19.8 |
| 6,053,025 | A | 4/2000 | Beetz et al. | |
| 6,109,088 | A | 8/2000 | Schrader et al. | |
| 6,128,943 | A | 10/2000 | Lemmens | |
| 6,807,840 | B2 | 10/2004 | Willhelm et al. | |
| 6,877,405 | B2 | 4/2005 | Brady et al. | |

(Continued)

FOREIGN PATENT DOCUMENTS

| | | |
|---|---|---|
| CH | 657559 | 11/2022 |
| CN | 205200415 | 7/2022 |

(Continued)

*Primary Examiner* — Sarang Afzali
*Assistant Examiner* — Darrell C Ford
(74) *Attorney, Agent, or Firm* — Snell & Wilmer LLP

(57) ABSTRACT

A crimping tool is for crimping at least two members together and confirming that the crimp is acceptable. The tool includes a first handle element and a second handle element, a first jaw pivotably coupled to the first handle element and a second jaw pivotably coupled to the second handle element such that the first and second jaws move between open and closed positions responsive to movement of the first and second handle elements, an insert assembly comprising a number of mounting members coupled to at least one of the first and second jaws, and at least one gauge removably coupled to at least one of the number of mounting members.

20 Claims, 6 Drawing Sheets

(56) References Cited

U.S. PATENT DOCUMENTS

| | | | | |
|---|---|---|---|---|
| D532,672 | S | 11/2006 | Steiner | |
| D534,412 | S | 1/2007 | Steiner | |
| 7,458,462 | B2 | 12/2008 | Carr | |
| 7,628,052 | B2 | 12/2009 | Zhang | |
| 7,854,185 | B2 | 12/2010 | Zhang et al. | |
| 8,151,618 | B2 | 4/2012 | Polofsky | |
| 8,276,429 | B2 | 10/2012 | Steiner et al. | |
| 8,296,924 | B2 | 10/2012 | Dierks et al. | |
| 8,342,001 | B2 | 1/2013 | Zhang | |
| 8,516,872 | B2 | 8/2013 | Battenfeld et al. | |
| 8,516,931 | B2 | 8/2013 | Steele et al. | |
| 8,590,352 | B2 | 11/2013 | Bowles et al. | |
| D705,035 | S | 5/2014 | Horvath | |
| 8,776,646 | B2 | 7/2014 | Chervenak et al. | |
| 9,089,958 | B2 | 7/2015 | Cleland | |
| 9,257,806 | B2 | 2/2016 | Lai et al. | |
| 9,425,573 | B2 | 8/2016 | Tsai | |
| 9,444,211 | B2 | 9/2016 | Tsai | |
| 9,484,700 | B2 | 11/2016 | Kehoe | |
| 9,543,725 | B2 | 1/2017 | Li | |
| D778,701 | S | 2/2017 | Gargano et al. | |
| 9,950,413 | B2 | 4/2018 | Cleland | |
| 9,991,660 | B2 | 6/2018 | Kehoe | |
| D828,738 | S | 9/2018 | Constantine | |
| 10,150,153 | B1 | 12/2018 | Goede | |
| 10,343,295 | B2 | 7/2019 | Feuerstein et al. | |
| 10,486,289 | B2 | 11/2019 | Erbrick | |
| 11,090,822 | B2 | 8/2021 | Feuerstein et al. | |
| 11,289,866 | B2 | 3/2022 | Kelly et al. | |
| 11,331,777 | B2 | 5/2022 | Glockseisen et al. | |
| 11,577,299 | B2 * | 2/2023 | Chen | B21D 39/046 |
| 12,318,896 | B2 * | 6/2025 | Rosenthal | F16L 13/141 |
| 2006/0225538 | A1 * | 10/2006 | Brown | B25B 27/10 81/126 |
| 2009/0013835 | A1 * | 1/2009 | Kidd | B21D 39/046 81/423 |
| 2009/0308132 | A1 | 12/2009 | Lai et al. | |
| 2010/0242276 | A1 * | 9/2010 | Pelkkala | B21D 39/048 29/748 |
| 2012/0125074 | A1 | 5/2012 | Zhang | |
| 2012/0159756 | A1 | 6/2012 | Zhang | |
| 2014/0298879 | A1 * | 10/2014 | Jarvi | B21D 39/046 72/454 |
| 2018/0085903 | A1 * | 3/2018 | Wackwitz | B25F 5/02 |
| 2019/0084136 | A1 | 3/2019 | Kundracik | |
| 2020/0161822 | A1 | 5/2020 | Glockseisen | |
| 2021/0008611 | A1 | 1/2021 | Krause et al. | |
| 2021/0083444 | A1 | 3/2021 | Lin | |
| 2021/0140840 | A1 * | 5/2021 | Glockseisen | B25B 7/02 |
| 2021/0339411 | A1 | 11/2021 | Feuerstein et al. | |
| 2022/0105606 | A1 | 4/2022 | Fu | |
| 2022/0212317 | A1 | 7/2022 | Shen | |

FOREIGN PATENT DOCUMENTS

| | | |
|---|---|---|
| CN | 215579475 U | 11/2022 |
| DE | 102005003617 | 7/2022 |
| DE | 102008030773 | 7/2022 |
| DE | 2841588 | 11/2022 |
| EP | 1358967 | 2/2022 |
| JP | 5578732 | 6/2022 |
| JP | 3203320 U | 11/2022 |
| WO | 2007087413 | 8/2007 |

* cited by examiner

FITTING CRIMPING TOOL WITH CHECK GAUGE MOUNT

CROSS REFERENCE TO RELATED APPLICATION

This application claims priority to and claims the benefit of U.S. Provisional Patent Application Ser. No. 63/537,678, filed Sep. 11, 2023, the contents of which are incorporated by reference herein by their entirety.

FIELD OF THE INVENTION

The present invention relates to crimping tools. The present invention also relates to methods of operating crimping tools.

BACKGROUND OF THE INVENTION

Crimping tools, such as for crimping fittings onto pipes, are well known. Existing crimp tools have a number of drawbacks. First, existing tools are often difficult to use and/or don't allow for fine adjustment of the crimping force.

Also, after users crimp fittings (e.g., copper fittings), they often need to know whether or not the pieces being crimped are crimped properly, which is generally determined by whether the fitting has been crimped to a proper diameter. In order to determine whether the fittings have been properly crimped, users often employ gauges (e.g., GO/NO-GO gauges) to measure the external diameter of the fitting. These gauges are often misplaced or lost. In some other configurations, the gauges are mounted to the handle of the crimping tool. A problem with this configuration is that the user then has to stop using the tool (e.g. set it down so that the hand they are using to hold and operate the crimping tool is no longer on the handles) in order to access the crimping tool.

It is with respect to these and other considerations that the instant disclosure is concerned.

SUMMARY OF THE INVENTION

As one aspect of the disclosed concept, a crimping tool is provided for crimping at least two members together and confirming that the crimp is acceptable. The tool includes a first handle element and a second handle element, a first jaw pivotably coupled to the first handle element and a second jaw pivotably coupled to the second handle element such that the first and second jaws move between open and closed positions responsive to movement of the first and second handle elements, an insert assembly comprising a number of mounting members coupled to at least one of the first and second jaws, and at least one gauge removably coupled to at least one of the number of mounting members, the at least one gauge defining a first size determining member allowing receipt of the at least two members crimped together and a second size determining member rejecting receipt of the at least two members crimped together.

As another aspect of the disclosed concept, a method of operating the aforementioned crimping tool is provided.

Further objects, features, and advantages of the present invention over the prior art will become apparent from the detailed description of the drawings which follows, when considered with the attached figures.

DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

As employed herein, the term "coupled" shall mean connected together either directly or via one or more intermediate parts or components. As employed herein, the term "number" shall mean one or an integer greater than one (i.e., a plurality).

Aspects of the invention comprise a crimping tool, such as for crimping at least two members, such as fittings, together and confirming that the crimp is acceptable. In one embodiment, the crimping tool has jaws which are configured to removably receive different crimping heads or inserts (such as for crimping fittings of different sizes). In one embodiment, the crimping tool includes a means for selectively controlling the crimping force, such as by an adjustable cam member which is associated with a pivot connection of handles of the tool. In another embodiment, the crimping tool includes means for removably associating one or more fitting gauges, such as GO/NO-GO gauges, with the jaws of the tool. These different features may be used independently or, in a preferred embodiment, conjunctively with the tool.

Figure 1:
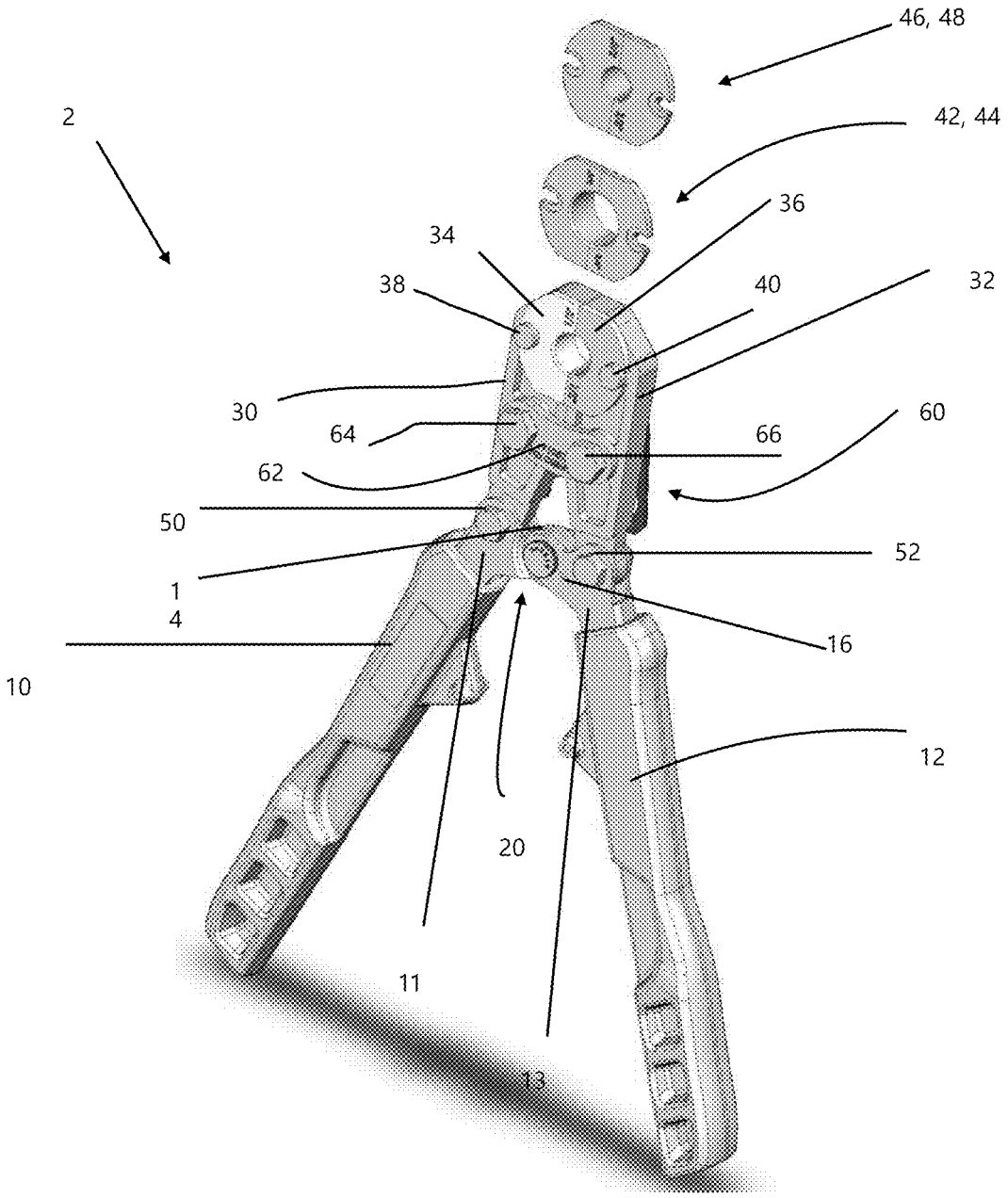
FIG. 1 is a front isometric view of a crimping tool, shown with a pair of additional tool heads exploded, in accordance with one non-limiting embodiment of the disclosed concept.

FIG. 1 is an isometric view of a crimping tool 2, in accordance with one non-limiting embodiment of the disclosed concept. As shown, the crimping tool 2 includes first and second handle assemblies that each include optional casings or covers 10, 12 (e.g., housings made of monomeric materials, polymeric materials, mixtures thereof, and/or glass reinforced polycarbonate for strength and light weight) which are coupled to (such as by comprising sleeves placed over, or by hot dipping onto) the handle elements 11, 13. The casings or covers 10, 12 may include grooved regions (shown but not labeled in FIG. 1) at ends thereof to allow for gripping during use. Moreover, the crimping tool 2 also includes first and second jaws 30, 32. In one example embodiment, the first and second handle elements 11, 13 and the first and second jaws 30, 32 are each made of metallic materials. In other embodiments, the handles 11, 13 might not include casings or covers.

Figure 3:
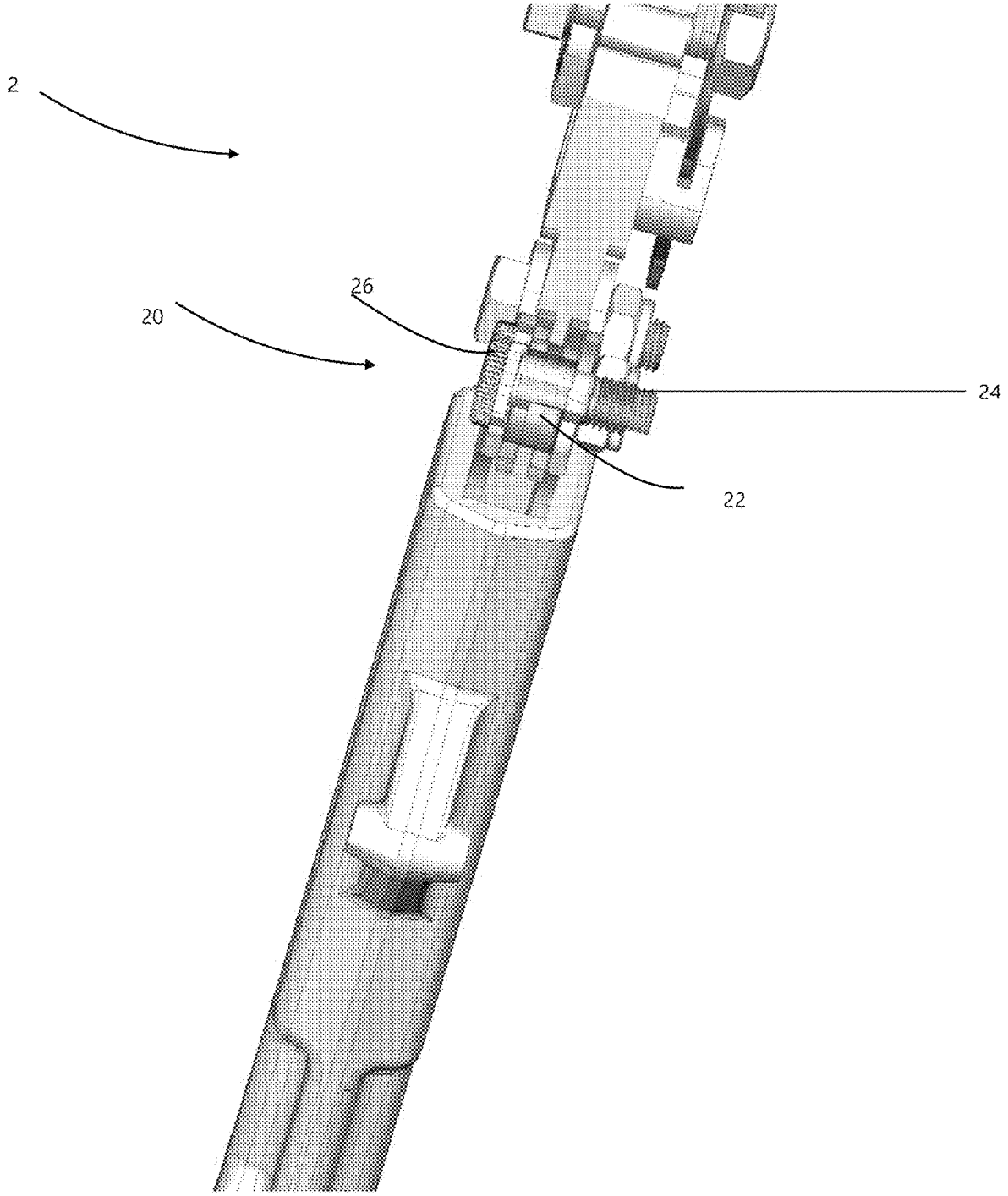
FIG. 3 is another isometric view of a portion of the crimping tool of FIG. 1.

Additionally, the first and second handle elements 11, 13 may be pivotally coupled together via an adjustable central cam-bolt apparatus 20. More specifically, the first handle element 11 may include a male connection component 14, the second handle element 13 may include a female connection component 16, and the cam-bolt apparatus 20, as shown in FIG. 3, preferably includes a cam 22 positioned between the male and female connection components 14, 16, and a bolt 24 extending through each of the male and female connection components 14, 16, and configured to engage the cam 22. The bolt 24 (FIG. 3) preferably has a head 26, and as shown in FIG. 1, the head 26, which may be circular-shaped or hex-shaped, is advantageously configured to be rotated by a user with respect to the first and second handle elements 11, 13. In this manner, a crimping force applied by the first and second jaws 30, 32 to, for example and without limitation, copper fittings, is advantageously able to be controlled and varied (e.g., different settings of the head 26 correspond to different crimping forces at the first and second jaws 30, 32). In this manner, the cam-bolt apparatus 20 provides an adjustable off-set for the crimping tool 2 wherein different, for example, lobes of the cam 22 allow for crimps of fittings to be performed in a calculated and/or accurate manner. Stated differently, a flat face of the bolt 24 locks with the cam 22, whose outer diameter is concentric with the male connection component 14 but eccentric with an axis of the bolt 24. As a result, this creates an offset between the male and female connection components 14, 16 wherein the amount of offset is adjustable by changing the orientation of the head 26 with respect to a splined opening on an adjustment plate. Accordingly, if a user desires a strong crimp, such as corresponding to a reduced diameter crimp, the user can twist the head 26 in, for example, a clockwise direction, whereas if the user desires a less strong crimp, such as corresponding to reduced, but not severely reduced, diameter, the user can twist the head 26 in a counterclockwise direction.

Continuing to refer to FIG. 1, the crimping tool 2 further includes first and second tool heads or jaw inserts 34, 36, which may be made of metallic materials, monomeric materials, polymeric materials, and mixtures of such materials, and which are coupled to the first and second jaws 30, 32 via first and second coupling members 38, 40 (e.g., rivets, bolts and nuts, other fasteners, etc.). The tool heads or jaw inserts 34, 36 are configured to define a first diameter and engage and crimp (e.g., press down into and deform a fitting from a first diameter to a second, reduced diameter, in a localized region) a fitting when in a closed position, such as depicted in FIG. 1.

Additionally, it will be appreciated that the first and second jaws 30, 32 are configured to also be coupled to or receive other tool heads 42, 44, 46, 48 by de-coupling the first and second tool heads 34, 36 via the coupling members 38, 40. In this manner, the other tool heads 42, 44, 46, 48, which define second diameters (e.g., via the members 42, 44) and third diameters (e.g., via the members 46, 48) provide the crimping tool 2 with the ability to produce three different diameter crimps. It will also be appreciated that other tool heads (not shown) having fourth, fifth, and sixth different diameters may also be coupled to the first and second jaws 30, 32 to allow for even further variability in terms of fittings which may be crimped by the crimping tool 2. In one embodiment, the coupling members 38,40 are biased pins and the heads or inserts 34,36 each define a slot at a peripheral portion thereof for accepting a corresponding one of the pins. In such a configuration, the user may pull the pin outwardly to remove and replace the head or insert 34,36 and then release the pin so that the biasing force thereon (such as created by a spring) presses the pin into engagement therewith to maintain the head or insert 34,36 to the corresponding jaw 30,32.

Additionally, as shown, the first and second handle elements 11, 13 are each configured to be coupled, preferably rotatably, to a corresponding one of the first and second jaws 30, 32 via corresponding coupling members 50, 52, which may be bolts and nuts, rivets, or other suitable fasteners. In this manner, during use, once the first and second jaws 30, 32 are secured to a fitting, movement of the first and second handle elements 11, 13 toward each other allow a suitable crimp to be made to the fitting.

Figure 2:
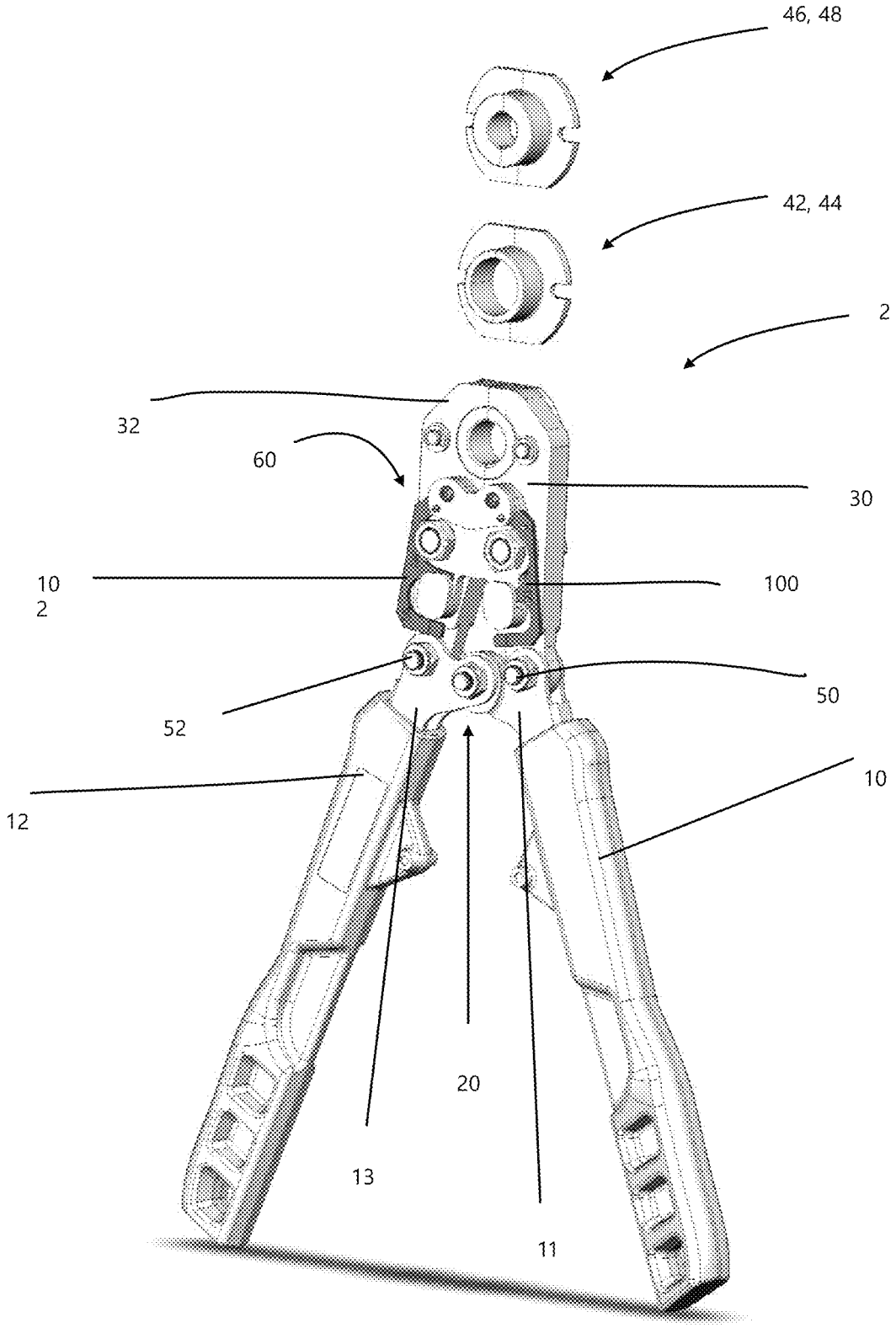
FIG. 2 is a rear isometric view of the crimping tool and pair of additional tool heads of FIG. 1.

In accordance with the disclosed concept, the crimping tool 2 also includes a convenient and reliable mechanism by which crimped fittings can be assessed and/or tested for proper use in the field. More specifically, and referring to FIG. 2, the crimping tool 2 further includes an insert assembly 60 and a number of GO/NO-GO gauges (e.g., two example gauges 100, 102 are shown in FIG. 2). The gauges 100, 102 may be employed to check for a preload for correct crimping force and also to function as a GO/NO-GO gauge, e.g., to make sure the size of the crimp is proper.

Figure 6:
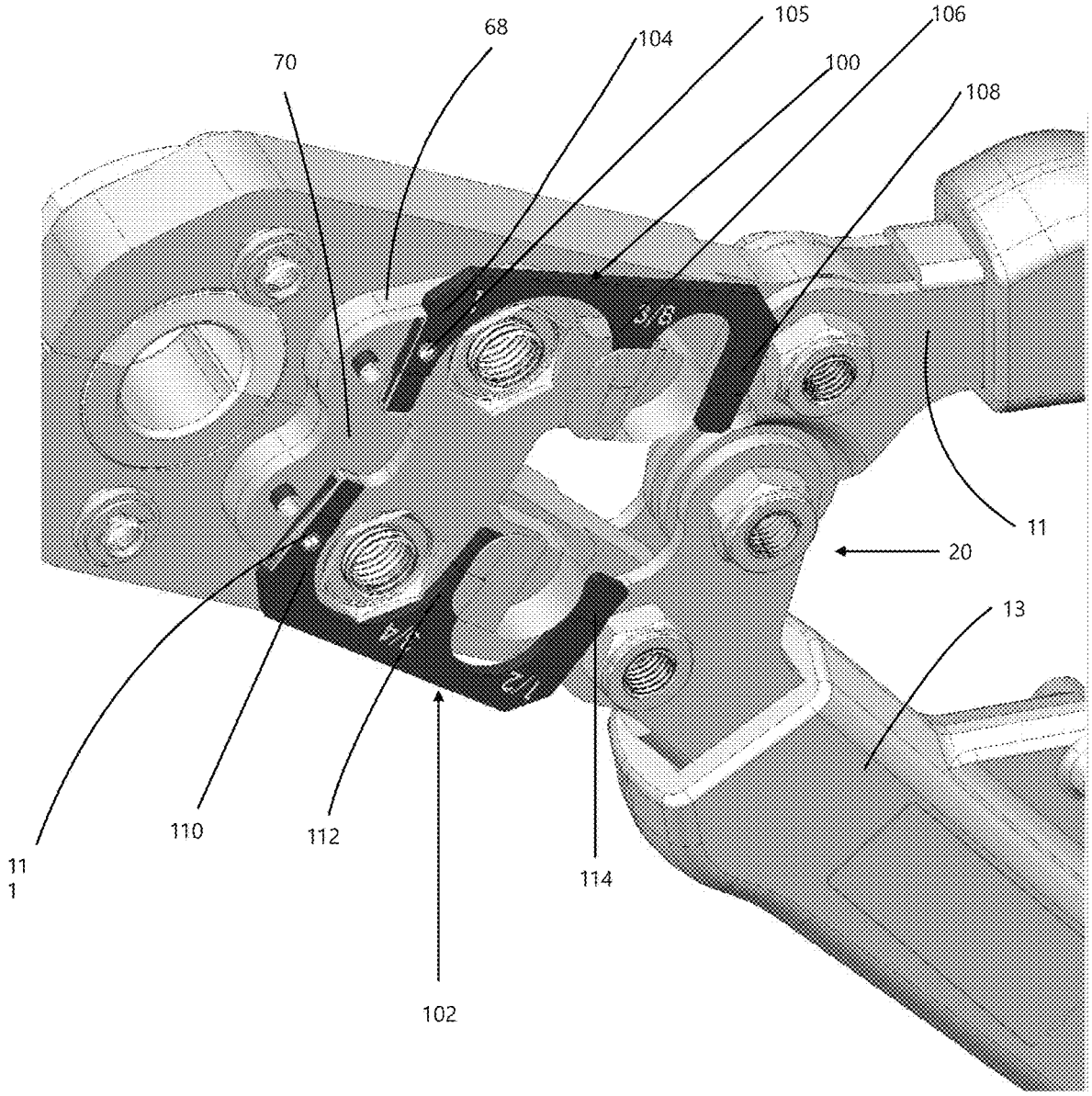
FIG. 6 is another rear isometric view of a portion of the crimping tool of FIG. 1, shown with a portion of the insert assembly removed in order to see hidden structures.

Each of the gauges 100, 102, as shown in FIG. 6, is generally E-shaped and defines a first size determining member allowing receipt of a first sized crimp fitting and a second size determining member allowing receipt of a second sized crimp fitting. For example, the size determining members may correspond to 1", 3/8", 1/2" and/or 3/4" sized crimp fittings, or other sizes as desired. The size determining members may be configured in each of the two gauges 100, 102 as three corresponding elongated portions 104, 106, 108, 110, 112, 114 that together define the two size determining members (between corresponding pairs of the elongated portions) for receiving two different diameter fittings (where the size determining members may be arcuate depressions, such as being semi-circular or substantially semi-circular in shape). In other words, elongated portions 104, 106, 108 of gauge 100 define two different size determining members to test two different diameter crimps for suitability, and elongated portions 110, 112, 114 of gauge 102 define two other size determining members having, in one example, different diameters than the size determining members of gauge 100, wherein the four size determining members all have different diameters, thereby allowing four different diameter crimps to be checked with the one single crimping tool 2, via the gauges 100, 102. Furthermore, the gauges 100, 102 are configured to be pivoted toward and away from one another responsive to the first and second jaws 30, 32 moving between the open and closed positions. Of course, in certain configurations, the gauge might define only a single size determining member or more than two, such as three or more.

In accordance with the disclosed concept, the gauges 100, 102 are advantageously configured to be removably coupled to the insert assembly 60, which is associated with/defined by the first and second jaws 30, 32. In this manner, after a user has crimped a fitting (e.g., via the tool heads 34, 36, 42, 44, 46, 48), accessing either or both of the gauges 100, 102 is relatively simple, in that all the user has to do is remove the gauge(s) from the insert assembly 60, which is conveniently located at the sides or faces of the first and second jaws 30, 32.

Coupling of the insert assembly 60 to the first and second jaws 30, 32, and coupling of the gauges 100, 102 to the insert assembly 60 will now be described in detail. Referring again to FIG. 1, the insert assembly 60, in one example embodiment, includes a first mounting member 62 coupled to a first side of each the jaws 30, 32, and a pair of coupling members 64, 66 each extending through the first mounting member 62, through a corresponding one of the first and second jaws 30, 32, as well as through the second mounting member 68. The coupling members 64, 66 may be bolts and nuts, rivets, or other suitable fasteners. The coupling members 64, 66 rotatably connect, via the first mounting member 62, the first and second jaws 30, 32 to one another (whereby, as shown, the first and second handles 11, 13 are rotatably connected to one another, the first handle 11 is rotatably connected to the first jaw 30, the second handle 13 is rotatably connected to the second jaw 32, and then the first and second jaws 30, 32 are rotatably connected, such as above their connections to the handles 11, 13). Furthermore, the coupling members 64, 66 are configured to be received by either the first or second size determining members of the first or second gauges 100, 102.

Figure 5:
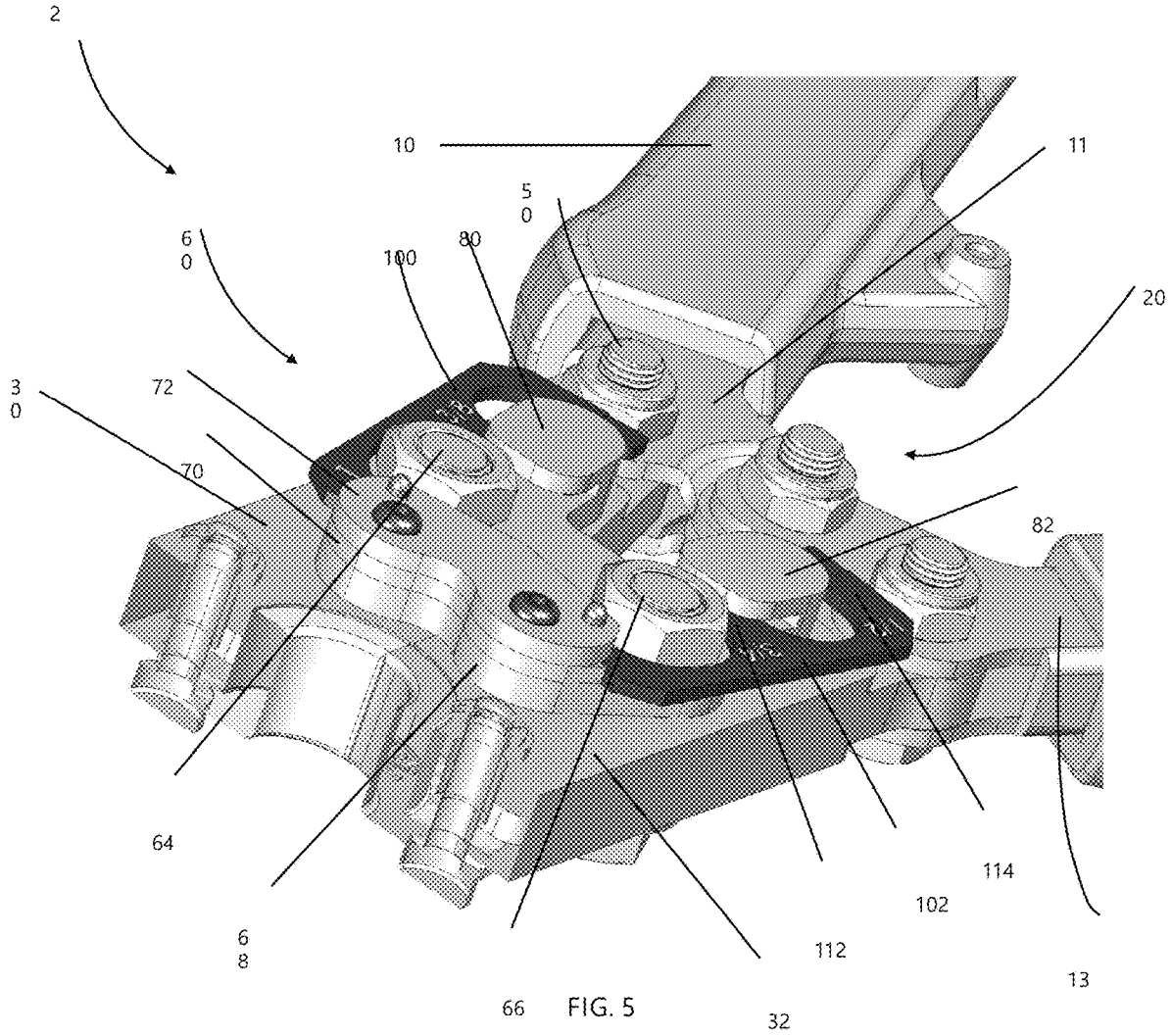
FIG. 5 is a top isometric view of a portion of the crimping tool of FIG. 1.

Referring to FIG. 5, the insert assembly 60 further includes second, third, and fourth mounting members 68, 70, 72 coupled to an opposing (e.g., opposite the first mounting member 62) side of the first and second jaws 30, 32. In one example, each of the mounting members 62, 68, 70, 72 and the gauges 100, 102 are preferably spaced from each of the first and second handle elements 11, 13 as well as spaced from the first and second jaws 30, 32. Additionally, in one example, the first, second, third, and fourth mounting members 62, 68, 70, 72 may each be made of monomeric materials, polymeric materials, or mixtures thereof (e.g., without limitation, may be injection-molded pieces).

Additionally, the second mounting member 68, in one example, may be directly mounted to and engage each of the first and second jaws 30, 32. The fourth mounting member 72 may be spaced from the second mounting member 68, and the third mounting member 70 may be located between and engage each of the second and fourth mounting members 68,72 in a manner wherein engaging surfaces are parallel to one another (e.g., are flush with respect to each other). Further, the first mounting member 62 may be located parallel to the third and fourth mounting members 70, 72. It will be appreciated that the first mounting member 62 (FIG. 1) advantageously functions to allow a load from the second, third, and fourth mounting members 68, 70, 72 to be dispersed across an opposite side of the first and second jaws 30, 32, e.g., by way of the coupling members 64, 66. In operation, the first, second, third, and fourth mounting members 62, 68, 70, 72 function to maintain the gauges 100, 102 on the crimping tool in a removable manner wherein, responsive to a predetermined force being applied to either of the gauges 100, 102 (such as via a user grasping it), the gauges 100, 102 "pop" or slide out of the insert assembly 60 and allow a user to determine whether a crimp is a GO or NO-GO (e.g., wherein the crimp is a NO-GO when it fits too loosely the bottoms out in the appropriately sized receiving portion, or does not fit at all in a receiving portion of one of the gauges 100, 102, and is a GO when it snugly fits in the receiving portion without bottoming out, as is known).

In order to appreciate the removable coupling of the gauges 100, 102 with respect to the rest of the crimping tool 2, reference will be made to FIG. 6, which shows a portion of the crimping tool 2 without the fourth mounting member 72 (FIG. 5). As can be appreciated, the first elongated portions 104, 110 of the E-shaped gauges 100, 102 are each configured to be received in a pocket defined by the second, third, and fourth mounting members 68, 70, 72 (FIG. 5). Furthermore, as shown in FIG. 6, the first elongated portions 104, 110 each have a corresponding detent 105, 111 (e.g., a bulge or protrusion extending outwardly from an otherwise planar surface). In one example, the fourth mounting member 72 (FIG. 5) has a pair of grooves which are each configured to receive a corresponding one of the detents 105, 111 in a snap-fit manner. As such, when a user desires to check a crimp that he or she has made on a fitting with the crimping tool 2, all the user needs to do is apply at least a predetermined force to either or both of the gauges 100, 102 (e.g., pull one of the gauges 100, 102 outwardly in a direction parallel to a plane of the fourth mounting member 72), which is sufficient to overcome the friction between the corresponding detent 105, 111 and the corresponding groove, which will allow either or both of the gauges 100, 102 to "pop" out. In turn, once the user is finished using either or both of the gauges 100, 102, all the user has to do is insert the elongated portions 104, 110 into the insert assembly 60 until the detents 105, 111 align with the grooves, at which point the elongated portions 104, 110 will "pop" into place. In this manner, the detents 105, 111 and grooves function to maintain the gauges 100, 102 in the insert assembly 60, and also to allow users to align the gauges 100, 102 with the insert assembly 60 after use.

Figure 4:
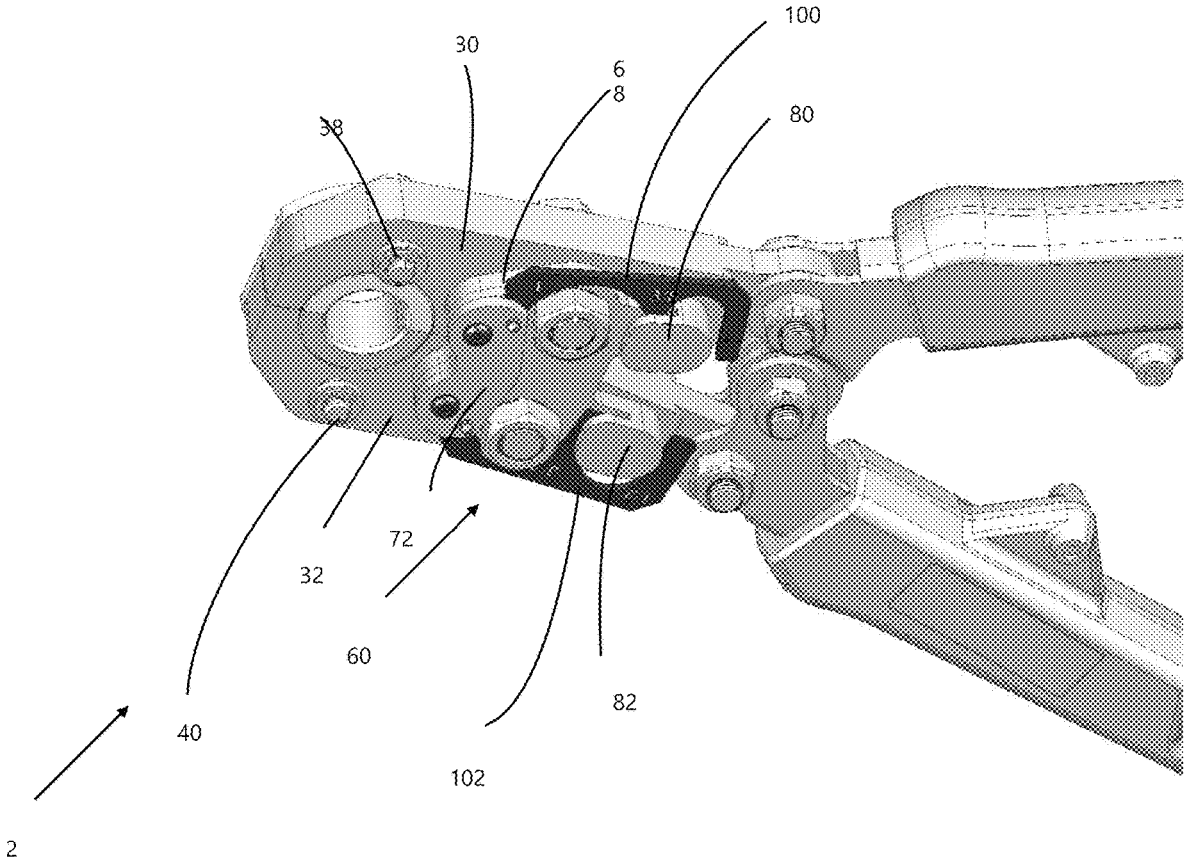
FIG. 4 is another rear isometric view of a portion of the crimping tool of FIG. 1

Furthermore, as shown in FIG. 5, the insert assembly 60 is configured to reliably maintain a connection with the gauges 100, 102 beyond the snap-fit connection with the detents 105, 111 and the grooves of the fourth mounting member 72. More specifically, as shown, the second mounting member 68 has a pair of receiving portions 80, 82 that each define a pocket into which a corresponding one of the second elongated portions (only the second elongated portion 112 of the gauge 102 is labeled in FIG. 5) are configured to be received. In one example, the pockets of the receiving portions 80, 82 have a width that is greater than a thickness of the gauges 100, 102, in particular at the second elongated portions 112, thereby allowing the second elongated portions 112 to better be maintained in the insert assembly 60, e.g., they would engage the receiving portions 80, 82 if a force attempted to move them laterally (e.g., perpendicular to an axis of rotation of the handle elements 11, 13). Additionally, and continuing to refer to FIG. 5, in one example the first and second elongated portions of the gauges 100, 102 define diameters that are greater than maximum diameters of nuts of the coupling members 64, 66, thereby allowing the gauges to properly mate with the insert assembly 60. Furthermore, and referring to FIG. 4, the pockets of the receiving portions 80, 82 preferably extend at least halfway through a longitudinal thereof, e.g., as shown in FIG. 4 the second elongated portions of the gauges 100, 102 each extend into a different distance into the corresponding receiving portions 80, 82. As such, the receiving portions 80, 82 accommodate gauges that are suited for a plurality of different crimp diameters.

Accordingly, the disclosed concept provides for a convenient and reliable mechanism by which the gauges 100, 102 can be easily accessed (e.g., are located and stored right where the user's hands will be during a crimping operation such that immediately after crimping a fitting, the user can move his or her hand a de minimis amount to locate and retrieve the gauges 100, 102), used to assess whether a crimping on a fitting is a GO (e.g., is suitable for use) or is a NO-GO (e.g., requires further crimping by the crimping tool or has been crimped too much), and then returned to their storage place in the insert assembly 60. In this manner, the insert assembly 60 is uniquely engineered to accommodate the geometry of the E-shaped gauges 100, 102. Stated differently, the receiving portions 80, 82 and the detent 105, 111/groove connection together operate to reliably and removably maintain the gauges 100, 102 on the insert assembly 60 of the crimping tool 2.

Additionally, although the disclosed concept has been described in association with the elongated portions 104, 110 having the detents 105, 111, it will be appreciated that a suitable alternative crimping tool may employ elongated portions of gauges having grooves which mate with detents of mounting members of insert assemblies (e.g., a reverse arrangement), without departing from the scope of the disclosed concept. Other arrangements are also contemplated by the disclosed concept for removably mounting one or more gauges to the jaws (such as one or both jaws, and at either face thereof, or even at or into the sides thereof). For example, magnetic attractive forces may be employed to couple gauges to insert assemblies, or directly to first and second jaws. Moreover, the elongated portions 104, 110 may engage and removably couple to any of the mounting members 68, 70, 72, without departing from the scope of the disclosed concept. In some embodiments, slots might be formed in the peripheral side of one or both jaws for removably receiving a gauge, etc.

In one example embodiment of the disclosed concept, a method of operating the crimping tool 2 includes locating at least two members (e.g., a fitting and a pipe) between the first and second jaws 30, 32, moving the first and second handle elements 11, 13 with respect to each other in order to move the first and second jaws 30, 32 from the open position to the closed position, thereby crimping the two members, applying at least a predetermined force to the gauge 100, 102 in order to de-couple it from a corresponding one of the mounting members 68, 70, 72, and re-coupling the gauge 100, 102 to a corresponding one of the mounting members 68, 70, 72 in a snap-action manner. The method may also include rotating the head 26 of the cam 22 with respect to the first and second handle elements 11, 13, thereby allowing a crimping force applied by the first and second jaws 30, 32 to be varied. Advantageously, the gauges 100,102 can be accessed by a user while they are gripping the handles 11, 13 with one hand, such as by using their other hand to access the gauge(s). This allows the user to continue to hold and/or operate the tool 2 while accessing the gauge(s).

While various embodiments of the disclosed concept have been described, it will be apparent to those of ordinary skill in the art that many more embodiments and implementations are possible that are within the scope of this disclosed concept. In addition, the various features, elements and embodiments described herein may be claimed or combined in any combination or arrangement.

What is claimed is:

1. A crimping tool for crimping at least two members together and confirming that the crimp is acceptable, the tool comprising:

a first handle element and a second handle element pivotably coupled to the first handle element;

a first jaw pivotably coupled to the first handle element and a second jaw pivotably coupled to the second handle element such that the first and second jaws move between open and closed positions responsive to movement of the first and second handle elements;

an insert assembly comprising a number of mounting members coupled to at least one of the first and second jaws; and a first gauge removably coupled to at least one of the number of mounting members, a second gauge removably coupled to the at least one of the number of mounting members, the first gauge and the second gauge each defining a first size determining member allowing receipt of the at least two members crimped together and a second size determining member rejecting receipt of the at least two members crimped together, wherein the first and second gauges are configured to be pivoted toward and away from one another responsive to the first and second jaws moving between the open and closed positions.

2. The crimping tool according to claim 1, wherein the number of mounting members, the first gauge, and the second gauge are spaced from each of the first and second handle elements.

3. The crimping tool according to claim 1, wherein the number of mounting members comprises a first mounting member coupled to each of the first and second jaws.

4. The crimping tool according to claim 3, wherein the first mounting member is coupled to a first side of each of the first and second jaws, and wherein the number of mounting members comprises at least one other mounting member coupled to a second, opposite side of each of the first and second jaws.

5. The crimping tool according to claim 4, wherein the at least one other mounting member comprises a second mounting member coupled to the second side of each of the first and second jaws, a third mounting member coupled to the second mounting member, and a fourth mounting member coupled to the third mounting member, wherein the third mounting member is disposed between the second and fourth mounting members, and wherein the first gauge and the second gauge are positioned between the second and fourth mounting members.

6. The crimping tool according to claim 5, wherein the second mounting member has a receiving portion defining a pocket configured to receive a portion of at least one of the first gauge and the second gauge in order to removably maintain the first gauge and the second gauge on the second mounting member.

7. The crimping tool according to claim 5, wherein the insert assembly further comprises a first coupling member and a second coupling member, wherein the first coupling member extends through the first mounting member, the second mounting member, and the first jaw in order to couple the first and second mounting members to the first jaw, and wherein the second coupling member extends through the first mounting member, the second mounting member, and the second jaw in order to couple the first and second mounting members to the second jaw.

8. The crimping tool according to claim 5, wherein the first mounting member is disposed parallel to the third and fourth mounting members.

9. The crimping tool according to claim 4, wherein the first size determining member of the first gauge has an elongated portion having a detent configured to be received in a snap-action manner in a groove of one of the at least one other mounting member.

10. The crimping tool according to claim 4, wherein the first size determining member of the first gauge has an elongated portion having a groove configured to receive in a snap-action manner a detent of one of the at least one other mounting member.

11. The crimping tool according to claim 4, wherein the first gauge and the second gauge are each removably coupled to one of the at least one other mounting member, wherein the first size determining member and the second size determining member of the first gauge each have a diameter different from one another, and wherein the first size determining member and the second size determining member of the second gauge each have a diameter different from one another and different from the diameters of the first and second size determining members of the first gauge.

12. The crimping tool according to claim 11, wherein the insert assembly further comprises a first coupling member and a second coupling member each extending through a corresponding one of the first and second jaws in order to couple the first mounting member to the first and second jaws, and wherein the first and second coupling members are configured to be received by either the first or second size determining members of the first or second gauges.

13. The crimping tool according to claim 1, wherein the first and second handle elements are coupled together via an adjustable central cam-bolt apparatus.

14. The crimping tool according to claim 13, wherein the first handle element comprises a male connection component, wherein the second handle element comprises a female connection component, and wherein the cam-bolt apparatus comprises a cam positioned between the male and female connection components, and a bolt extending through each of the male and female connection components and configured to engage the cam.

15. The crimping tool according to claim 14, wherein the cam comprises a head that is configured to be rotated by a user with respect to the first and second handle elements, thereby allowing a crimping force applied by the first and second jaws to be varied.

16. The crimping tool according to claim 1, further comprising a first tool head and a second tool head each removably coupled to a corresponding one of the first and second jaws.

17. The crimping tool according to claim 1, wherein the first gauge and the second gauge are spaced from the first and second jaws.

18. A crimping tool for crimping at least two members together and confirming that the crimp is acceptable, the tool comprising:

a first handle element and a second handle element pivotably coupled to the first handle element;

a first jaw pivotably coupled to the first handle element and a second jaw pivotably coupled to the second handle element such that the first and second jaws move between open and closed positions responsive to movement of the first and second handle elements;

an insert assembly including a first mounting member coupled to a first side of each of the first and second jaws, a second mounting member coupled to a second, opposite side of each of the first and second jaws, a third mounting member coupled to the second mounting member, and a fourth mounting member coupled to the third mounting member wherein the third mounting member is disposed between the second and fourth mounting members; and at least one gauge removably coupled to at least one of the number of mounting members and positioned between the second and fourth mounting members, the at least one gauge defining a first size determining member allowing receipt of the at least two members crimped together and a second size determining member rejecting receipt of the at least two members crimped together.

19. A crimping tool for crimping at least two members together and confirming that the crimp is acceptable, the tool comprising:

a first handle element and a second handle element pivotably coupled to the first handle element;

a first jaw pivotably coupled to the first handle element and a second jaw pivotably coupled to the second handle element such that the first and second jaws move between open and closed positions responsive to movement of the first and second handle elements;

an insert assembly comprising a number of mounting members coupled to at least one of the first and second jaws, the number of mounting members including a first mounting member coupled to a first side of each of the first and second jaws and at least one other mounting member coupled to a second, opposite side of each of the first and second jaws; and a first gauge and a second gauge each removably coupled to at least one of the number of mounting members, the first gauge and the second gauge each defining a first size determining member allowing receipt of the at least two members crimped together and a second size determining member rejecting receipt of the at least two members crimped together, wherein the first size determining member and the second size determining member of the first gauge each have a diameter different from one another, and wherein the first size determining member and the second size determining member of the second gauge each have a diameter different from one another and different from the diameters of the first and second size determining members of the first gauge.

20. A crimping tool for crimping at least two members together and confirming that the crimp is acceptable, the tool comprising:

a first handle element comprising a male connection component;

a second handle element comprising a female connection component;

an adjustable central cam-bolt apparatus pivotably coupling the first handle element and the second handle element, the adjustable central cam-bolt apparatus comprising a cam positioned between the male and female connection components, and a bolt extending through each of the male and female connection components and configured to engage the cam;

a first jaw pivotably coupled to the first handle element and a second jaw pivotably coupled to the second handle element such that the first and second jaws move between open and closed positions responsive to movement of the first and second handle elements;

an insert assembly comprising a number of mounting members coupled to at least one of the first and second jaws; and at least one gauge removably coupled to at least one of the number of mounting members, the at least one gauge defining a first size determining member allowing receipt of the at least two members crimped together and a second size determining member rejecting receipt of the at least two members crimped together.

* * * * *